United States Patent [19]

Sottolana

[11] 4,320,588

[45] Mar. 23, 1982

[54] INSOLE, IN PARTICULAR FOR LADIES' SHOES

[76] Inventor: Giulio Sottolana, Via Mascheroni 15, Milan, Italy

[21] Appl. No.: 63,334

[22] Filed: Aug. 2, 1979

[30] Foreign Application Priority Data

Jul. 28, 1978 [IT] Italy ..... 22471 A/78

[51] Int. Cl.[3] ..... A43B 13/28; A43B 13/38

[52] U.S. Cl. ..... 36/24.5; 36/43

[58] Field of Search ..... 86/43, 44, 24.5; 128/595

[56] References Cited

U.S. PATENT DOCUMENTS

| | | | |
|---|---|---|---|
| 2,095,953 | 10/1937 | Bazzoni | 36/24.5 |
| 2,259,322 | 10/1941 | Parkhurst | 36/24.5 |
| 3,394,473 | 7/1968 | Romen | 128/595 X |
| 4,070,770 | 1/1978 | Vello | 36/43 |

FOREIGN PATENT DOCUMENTS

| | | | |
|---|---|---|---|
| 1918537 | 7/1971 | Fed. Rep. of Germany | 36/44 |
| 2030205 | 12/1971 | Fed. Rep. of Germany | 36/43 |
| 2137486 | 2/1973 | Fed. Rep. of Germany | 36/44 |
| 1016468 | 8/1952 | France | 36/30 R |
| 2371897 | 6/1978 | France | 36/43 |
| 1214020 | 11/1970 | United Kingdom | 36/43 |

*Primary Examiner*—James Kee Chi

*Attorney, Agent, or Firm*—Abelman, Frayne & Rezac

[57] ABSTRACT

The shoe bottom (FIG. 2) is made of a thermoplastic material and is profiled, in such a way that the upper surface thereof A shows, at its rear part, a depression A1 for the heel of the foot, that connects with the front of the shoe bottom by means of the curved lengths A2 and A3, to terminate with an ample area A4 for the sole of the foot. The lower surface B of the shoe bottom is correspondingly shaped and shows, at the rear part thereof, a flat notch B1 for the heel of the shoe and successively, an arch-shaped profile $B_2$ and $B_3$, the radiuses of curvature of which increase from the heel toward the sole. As a consequence, the thickness of the shoe bottom decreases gradually from the heel toward the toe. The lower surface of the shoe bottom shows, in front, a notch $B_4$ to house an element resistant to wear, made of leather or of another appropriate material.

10 Claims, 6 Drawing Figures

INSOLE, IN PARTICULAR FOR LADIES' SHOES

The present invention concerns a shoe bottom for shoes, in particular for ladies' shoes. The said shoe bottom is constructed to meet satisfactorily, with special reference to the physiological viewpoint, the user's requirements, in order to produce lightweight and resistant shoes, fulfilling also to the aesthetic requirements.

Another purpose of the present invention is to provide of a shoe bottom which can be fitted, as required, with a heel and/or a sole-the said sole being fitted on to the front part of the shoe bottom-showing the desired features, without being prejudicial to the stoutness and flexibility of the above mentioned shoe bottom.

Still another purpose of the invention is to provide a lightweight and flexible shoe bottom capable of resisting the stresses of use and which can be equipped with a heel, even of a high heel, without impairing the structure thereof, during walking.

The shoe bottom according to the invention is characterized by a grooved upper surface, to house and retain the footsole and the lower surface of said shoe bottom retains, at the rear part thereof, the heel of the shoe, while the middle area is transversally curved and connected with the front part by means of arches of a circle of a progressively increasing width and with incremented radius of curvature, to form, at the front end, a substantially flat area or transversally flexible sale in correspondence with the articulations of the toes. The heel for the shoe can be either inserted or embodied in the shoe bottom.

The annexed drawing shows, by way of example, an advantageous form of embodiment of the above described shoe bottom according to the invention, advantageously made of a pressed plastic material, preferably of the thermoplastic type.

Figure 1:
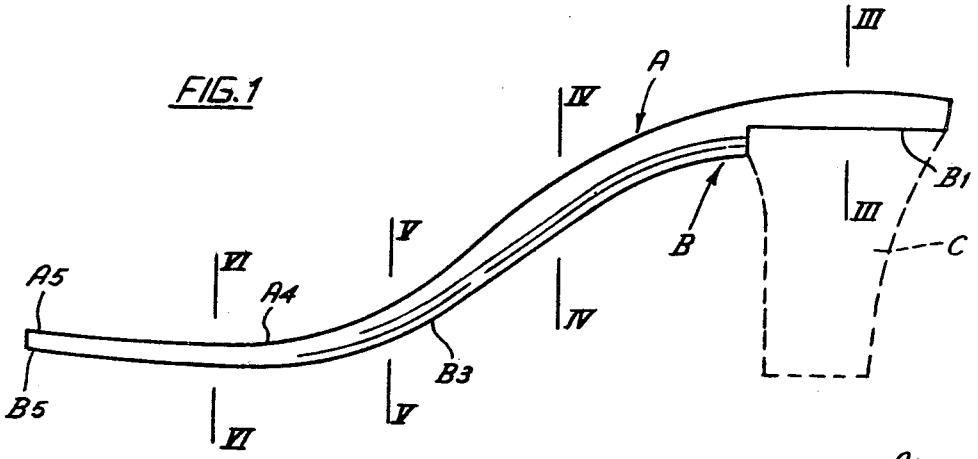
FIG. 1 is a side elevation of the shoe bottom.
Figure 2:
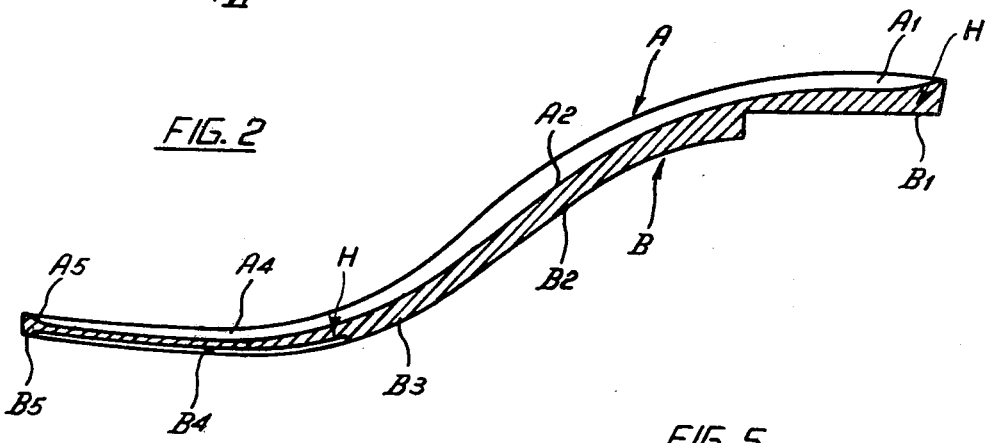
FIG. 2 is a longitudinal cross-section.
Figure 3:
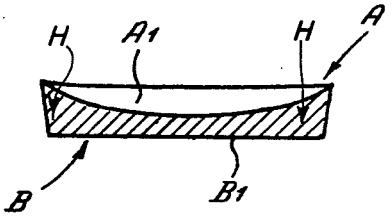
FIGS. 3 to 6 are sections, on an enlarged scale and, respectively, on the lines from III—III to VI—VI of FIG. 1.
Figure 4:
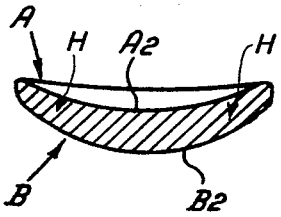
Figure 5:
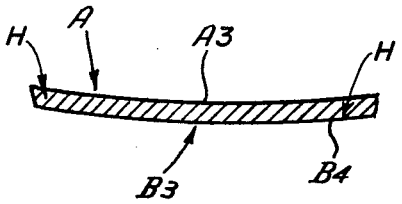
Figure 6:
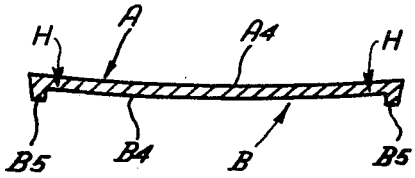

With reference to the figures of the drawing, the illustrated shoe bottom consists of a body of a pressed thermoplastic material, which is advantageously shaped, in such a way as to form, in relation to the upper surface A thereof, a rear cavity A1 which houses the heel of the foot and which connects, at the front side, with a middle length A2, downwardly inclined and appropriately curved transversally, to house and to retain the hollow of the foot. The surface related to the middle length A2 extends then in the direction of the front part of the shoe bottom with a curved length A3, to terminate with an ample area A4 for the sole of the foot. This area is slightly hollow and terminates with a point A5 which is slightly upturned, in order to house and to retain the toes of the foot.

The lower face B of the shoe bottom is shaped accordin: toward the rear part thereof it retains the heel C for the shoe, which can form a single body with the shoe bottom or otherwise be inserted into it and fixed there, for instance by means of screws. In the last mentioned case the shoe bottom can show a flat area B1 to retain the heel of a shoe of any appropriate type.

The middle part of the lower face B of the shoe shows a profile B2 which is substantially identical with that (A2) of the upper surface: but the transverse curve of the said profile is such as to form a beam, the thickness of which decreases rapidly in the direction of the front part, while its length increases toward the sole. In other words, the transverse bending radius of curvature of area B2 is less than the corresponding transverse radius of the grooving A2 and the said radius increases gradually during its approach to the sole. In such a way, as well as in relation to the variation of the radius concerned, and to the width thereof, a shaped beam B3 is realized in relation to the middle part of the shoe bottom, the thickness of which decreases from the rear to the front part of the shoe bottom, to provide, within the area of sole B4, particularly in the part corresponding to the articulation of the toes, according to sectional line VI—VI, an advantageously reduced thickness having maximum flexibility, to allow for an easy and quick walk of the wearer. The front area B4 of the shoe bottom can be provided with a cavity B6 of appropriate depth and delimited, at least partly, by an edge B5 of an appropriate width; the said cavity is designed to house and retain an element having a good resistance to wear, for example of leather and fixed there by means of an adhesive or another appropriate way, since the aforementioned element of long wear is retained by the walls of edges B5. If desired and in particular when edge B5 extends to the sole, said edge can be provided with longitudinal rifles or the like, to facilitate the execution of seams or the like designed to grip and retain the element of long wear, the uppers or other parts of the shoe.

Due to the structure of the shoe bottom, even if it comprises areas of resistance to wear it maintains its flexibility of the sole almost unaltered. Furthermore the said shoe bottom, object of the present invention presents, as previously mentioned, a remarkable resistance, owing to its beam-like structure localized in the middle part thereof.

As above mentioned, the shoe bottom object of the invention is formed, at least in part, of a plastic material, for instance of the thermoplastic type such as polyamides, co-polymers and other similar products.

I claim:

1. A shoe bottom comprising a molded plastic reinforcement whose upper surface houses and retains the sole of a foot including the toe area; whose lower surface retains, at the rear part thereof, the heel of a shoe; whose middle part is arched-shaped in traverse direction increasing in width and radius of curvature from rear to front, and wherein the thickness of the shoe bottom decreases to reach substantially, at the front part of the shoe bottom in the toe area, a minimum thickness and a maximum flexibility.

2. The shoe bottom as claimed in claim 1, wherein the transverse radiuses of curvature of the upper surface of said middle part are greater than those of its lower surface, so as to form a shaped beam in longitudinal direction, the thickness of which decreases in the direction of the front part of the subsole.

3. The shoe bottom as claimed in claim 1 or 2 wherein the lower surface thereof presents, at its rear end, a flat surface to which the heel may be fixed.

4. The shoe bottom as claimed in claim 1 or 2, wherein the heel forms an integral part of the rear part of the subsole.

5. The shoe bottom as claimed in claim 1 or 2, wherein the lower surface of the front end has at least one cavity which houses an element having a long resistance to wear.

6. The shoe bottom as claimed in claim 1 or 2 wherein the lower surface of the front part has at least one cavity designed to house and to retain an element having a long resistance to wear.

7. The shoe bottom as claimed in claim 6, wherein the cavity is defined, at least in part, by a raised edge.

8. The shoe bottom as claimed in claim 7, wherein the raised edge is provided with longitudinal incisions.

9. The shoe bottom as claimed in claim 1 or 2 wherein the thinned and flexible area at the front part extends over a length ranging from one third to one half of the overall length of the said shoe bottom.

10. The shoe bottom claimed in claim 1 or 2 wherein the thickness of the thinned, flexible area at the front part ranges from one eighth to one fifth of the maximum thickness of the shoe bottom.

* * * * *